US007878383B2

(12) United States Patent
Marschel et al.

(10) Patent No.: US 7,878,383 B2
(45) **Date of Patent: *Feb. 1, 2011**

(54) SPRING LOADED SET TOOL FOR HARDWOOD PLANK STAPLES

(75) Inventors: Scott Marschel, Maple Lake, MN (US); Jack Clark, Buffalo, MN (US); Mike Drinkard, San Jose, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 104 days.

This patent is subject to a terminal disclaimer.

(21) Appl. No.: 12/324,633

(22) Filed: Nov. 26, 2008

(65) Prior Publication Data

US 2010/0127036 A1 May 27, 2010

(51) Int. Cl.
*B25C 7/00* (2006.01)

(52) U.S. Cl. ..... 227/148; 227/147; 227/119; 227/107; 227/146

(58) Field of Classification Search ..... 227/147, 227/148, 119, 120, 130, 146, 107
See application file for complete search history.

(56) References Cited

U.S. PATENT DOCUMENTS

| | | | | | |
|---|---|---|---|---|---|
| 913,914 | A | | 2/1909 | Kafer | |
| 1,016,383 | A | | 2/1912 | Wellman | |
| 1,213,334 | A | | 1/1917 | Chapman | |
| 2,430,532 | A | | 11/1947 | Rayburn | |
| 2,768,376 | A | * | 10/1956 | Critchley | 173/31 |
| 3,012,247 | A | * | 12/1961 | Sillars et al. | 227/121 |
| 3,360,176 | A | * | 12/1967 | Gehl et al. | 227/148 |
| 3,764,053 | A | * | 10/1973 | Thompson | 227/111 |
| 3,864,053 | A | * | 2/1975 | Harwood | 408/110 |
| 4,084,738 | A | * | 4/1978 | Schneider | 227/7 |
| 4,085,382 | A | | 4/1978 | Barber et al. | |
| 4,196,833 | A | * | 4/1980 | Haytayan | 227/8 |
| 4,450,998 | A | | 5/1984 | Ruskin | |
| 4,838,471 | A | | 6/1989 | Chiesa | |
| 4,858,813 | A | | 8/1989 | Wingert | |
| 4,903,882 | A | | 2/1990 | Long | |
| 4,907,730 | A | * | 3/1990 | Dion | 227/8 |
| 5,062,562 | A | * | 11/1991 | Michael | 227/111 |
| 5,868,183 | A | * | 2/1999 | Kozyrski et al. | 144/136.1 |
| 5,967,397 | A | | 10/1999 | Fealey | |
| 6,155,472 | A | * | 12/2000 | Deziel | 227/8 |
| 6,269,996 | B1 | * | 8/2001 | McAllister | 227/7 |
| 6,318,620 | B1 | * | 11/2001 | Anstett et al. | 227/147 |
| 6,527,156 | B2 | * | 3/2003 | McAllister et al. | 227/7 |
| D493,079 | S | | 7/2004 | Fowler | |
| 6,843,402 | B2 | * | 1/2005 | Sims et al. | 227/148 |
| 7,243,832 | B2 | | 7/2007 | Jiang | |
| 7,255,256 | B2 | * | 8/2007 | McGee et al. | 227/8 |
| 7,303,105 | B2 | | 12/2007 | Dion et al. | |
| 2007/0017953 | A1 | * | 1/2007 | Hamar | 227/8 |
| 2007/0057013 | A1 | * | 3/2007 | Deziel | 227/147 |
| 2007/0257081 | A1 | * | 11/2007 | Dion et al. | 227/148 |
| 2008/0296341 | A1 | * | 12/2008 | Francescon | 227/119 |

* cited by examiner

*Primary Examiner*—Brian D Nash
(74) *Attorney, Agent, or Firm*—Schneck & Schneck; David M. Schneck

(57) ABSTRACT

A tool for driving a floor staple including an outer tubular body and a rod insertable into the tubular body. The tubular body has an end tip having angled surfaces and an inner bore. The rod is biased with the inner bore. The inner bore has a staple slot allowing an exposed end a staple to fit within the outer tubular body. The rod has a hammering head, which when struck, drives staple into a flooring plank.

25 Claims, 15 Drawing Sheets

SPRING LOADED SET TOOL FOR HARDWOOD PLANK STAPLES

TECHNICAL FIELD

The present invention relates to flooring tools and more specifically for tools to set staples used for hardwood flooring installation.

BACKGROUND

In the installation of tongue and groove hardwood plank flooring materials, pneumatic staplers are commonly used to drive staples used to adhere the planks to the floor. These staplers are designed to sit flat on top of the hardwood plank and locate against a tongued side of the plank such that they can precisely drive the staple at a 45° angle at a point just above the tongue. The driving angle of 45° and driving elevation at the point just above the tongue are fixed and standard for most all modern pneumatic hardwood staplers. The standard angle and point of entry for driving staples works well because the hardwood planks themselves normally have standard tongue and groove dimensions.

FIG. 14 shows the shape of a typical modern hardwood staple 50. As used herein, a typical hardwood staple 50 has dimensions defined as follows: dimension 51 is the length of the hardwood staple (sometimes also referred to as a "leg"), dimension 52 is the width of the hardwood staple (sometimes also referred to as a "crown"), and dimension 53 is the thickness of the hardwood staple. Modern hardwood staples are typically wire form products made from round wire. Hence the crown 52 of this kind of staple tends to form a longitudinally rounded surface 54. In comparison to other staples, modern hardwood flooring staples have long, brittle legs that will easily break if they are not supported during the driving process.

FIG. 10 illustrates by way of a cross sectional view the proper stapling of a tongue and groove hardwood plank. A first plank 11 has a hardwood staple 12 driven fully at a 45° angle into the vertex 13 of the exterior angle formed by an outer edge 14 and a tongue 15 of first plank 11. Hardwood staple 12 anchors first plank 11 to subfloor 16. Provided hardwood staple 12 is fully driven into the vertex 13, the tongue 15 of plank 11 fits easily into groove 18 of second plank 17, and the stapling process continues by stapling at same area of the next plank (the vertex 19 of second plank 17).

As shown in FIG. 12, the exterior angle formed by tongue outer edge 74 on the tongued side of the plank and a tongue 75 of a typical hardwood plank 71 may not be a 90° angle. The angle D formed between tongue outer edge 74 and tongue 75 is normally about 89.5°. Similarly, groove outer edge 70 on the opposite groove side of the plank is at an angle E of about 88.5° in relation to a centerline 77 of the hardwood plank. As shown in FIG. 13, these angles relieve tongue outer edge 74 and groove outer edge 70 from each other when they are butted together. This ensures tongue outer edge 74 and groove outer edge 70 will only contact near tongue top edge 72, and groove top edge 73. This ensures that there will be minimal interference between the edges which could create a gap at top of the joint.

When using pneumatic hardwood staplers, knots in the hardwood plank or drops in air pressure may cause the nailer to only partially drive the staple, leaving an undesirable exposed staple head. FIG. 11 illustrates the problem. Hardwood staple 1 has been partially driven into the side of the hardwood plank, leaving an exposed staple head 10. Whenever there is an exposed staple head, the tongue of a first plank and the groove of the next plank will not fit together. The floor installation process comes to a halt.

Presently, hardwood installers normally carry snips and conventional nail sets to hammer down partially driven staples. The staple legs have to be separated from the crown, and then the legs can be driven using a conventional nail set. This is a difficult, time consuming process. If a set tool were available to drive the entire exposed staple head the rest of the way into the side of the plank, it would greatly speed the process of installation. The process of driving a partially driven staple or exposed staple head will be referred to herein as a process of "finish hammering" the hardwood staple.

Tools have been developed for hammering nails into the side of tongue and grooved flooring materials, but none for finish hammering modern hardwood staples from pneumatic staplers. For example, U.S. Pat. No. 1,016,383 to Wellman discloses a set tool with a plate which sits flat on the hardwood plank. The plate includes a "V-rib" or approximately 90° internal angled surface formed in its base. The V-rib is shaped to conform to the plank at the external angle formed by the outer edge of the plank and the tongue of the plank (also referred to as a "rabbet" as this term is used in woodworking). Thus, the V-rib functions to position the plate at a precise location "to permit the effective drive of nails". A circular "passage" for inserting a round headed nail is formed at a 45° degree angle through the plate to the vertex of the V-rib. Thus, when the point of the nail is inserted into the passage, it is automatically located at the optimal location for driving the nail at a 45° angle into the side of the plank.

In addition, the disclosed device includes a "punch or driving element" for use in connection with the plate. The punch is a generally cylindrical rod with a reduced outside diameter on one end which can slidably fit within the passage in the plate. This reduced diameter end can slide within the passage all the way to the bottom of the passage, and can thus drive the nail all the way down to the bottom of the passage. Thus, as this disclosure states, "the nail can be entirely driven into the flooring without removing the improved implement" (i.e., the "plate").

Wellman's floor set may have worked well for the purpose of driving nails, but it is not suitable for the purpose of finish-hammering partially driven modern hardwood staples. The reason is that the passages are merely cylindrical holes designed for the passage of round headed nails. In comparison, modern hardwood staples are fairly thin, U-shaped metal wire implements. Effectively driving such staples requires that the staple be precisely supported all the way into the plank by means of a precision staple channel shaped to create a precision slide fit with the dimensions of the staple. If a user attempted to drive such a staple with only a hammer, and a blunt round ended punch running inside a passage such as Wellman's, the lack of support means would cause the thin metal legs of the staple to bend over or break. The passage of the Wellman device will not provide the necessary precision support means. Finally, the passages of this device are enshrouded due to the bulk of the body. A thinner body such as a tube having relieved edges would make the process of inserting an exposed staple head into a passage or staple slot much more easy to see.

U.S. Pat. No. 913,014 to Kafer discloses a staple set for hammering a heavy duty staple used to adhere fence wires to wooden fence posts. Kafer states the tubular body of his set tool can be made from scrap tube from "recycled pipe sections" or "boiler flues". From this description, it may be inferred that such tubes are cylindrical shapes without internal features, and such is confirmed by his drawings. Kafer's tubes are threaded on both ends. One end receives a threaded cap having a staple slot. Since the staple slot of this device is formed only in the cap, the cross section of this slot is very thin. On the opposite end of the tube, a rod is inserted having a weighted handle. In use, the user inserts the fencing staple in the staple slot, grasps the weighted handle, and forcibly slides the rod to the bottom of the tube. The rod contacts and drives the staple into a post, thereby fastening a wire. This device is not useful for the purpose of finish hammering partially driven modern hardwood staples. The staple slot, being formed only in the cap of this device, is simply not long enough to support the long legs of these staples. Without precision support for both legs, the legs would bend or break. Furthermore, the end of the tubular body where the staple exits the device, and the driving head of the rod of this device, both have bulky square cross sections. Neither end surface has the type of relieved edges necessary to enter the external angle formed by the outer edge of the plank, and the tongue of the plank. Lastly, the staple driving head of the rod of this device appears to have no means for accepting the rounded crown of the staple, but appears only to be a flat surface. To finish hammer modern hardwood staples, it would be preferable to provide a staple receiving groove in the driving head of the rod. This is because that the crown of a modern hardwood staple has a rounded surface along the longitudinal axis of the crown. Such a groove would prevent the staple from bending, and would assist the user in locating the set tool over the head of the staple. Furthermore, it would be preferred that the tip of a set tool for finishing modern hardwood staples be as thin as possible, possibly made from a thin strip of metal. Such a thin tip could finish hammer the hardwood staple below flush into the side of the hardwood plank, making it easier to fit the tongue and grooved sections of the plank together. However, if a thin tip is employed, a precision groove on the driving end would become even more important in order to prevent such a tip from skipping over the crown of staple.

Other prior art set tools have been developed for driving staples, but they all have drawbacks. U.S. Pat. No. 1,213,334 to Chapman discloses a single-piece driving rod type staple set with a plurality of "sockets" (i.e., "blind-hole" staple channels) of varying depths formed in its driving head. The reference states that "the sockets are made of gradually decreasing depths so as to accommodate the staple at various stages of its entrance into the wood in which it is being set." Thus, the user begins by inserting a staple in the deepest channel, and hammers on the opposite end to start the driving process. Once the driving head contacts the wood, the user inserts the staple head into one the shallower sockets, and the staple can be driven further. The legs of the staple are supported by the various sockets, preventing them from spreading or bending over. This device is not suitable for the purpose of finish hammering hardwood staples because the plurality of sockets requires a wide head. Such a wide head does not easily enter the external angle formed by the outside edge of the plank and the tongue of the plank. Furthermore, modern hardwood staples are by comparison much longer and thinner than the staples shown by Chapman. More sockets of even greater depth would be necessary, and the sockets would need to be narrow. Forming enough narrow blind sockets into the head would become impractical. What is needed is a tool with a single staple slot with a length at least as long as the hardwood staple, and a separate movable means of driving the head of the hardwood staple down the length of the staple channel.

Other similar set tools such as that disclosed in U.S. Pat. No. D493,079 S to Fowler, have more compact, relieved driving heads which include a single staple socket. Such a compact driving head can more easily enter the external angle formed by the outside edge of the plank, and the tongue of the plank. However, there is no means of support for the legs of the staple. This type of tool is not helpful in cases where the staple protrudes a significant distance from the hardwood plank. Without support during the driving process, the staple would simply bends over or breaks.

U.S. Pat. No. 2,430,532 to Rayburn discloses a spring activated set tool for small pins or brads used in soft woods. Specifically it is designed to function "without the use of a hammer". This tool has a bottom body called a "guide" having a bore forming guidance means for pins or brads. The guide has relieved edges on the end where the opening of the bore is formed. The bore itself is a circular hole suitable to support round headed pins or brads. Additionally, the tool has a "head" with a hollow "barrel" that fits in a telescoping fashion over the guide. Within the barrel, a cylindrical plunger is mounted that inserts into the bore of the guide. A spring is inserted over the plunger and inside the barrel that rests on the top of the guide. In use, the user pushes the head, forcing the plunger to drive a pin or brad down the bore of the guide. Afterwards, the spring lifts the head and the plunger in the bore is raised. This makes space in the bore for insertion of another brad. Fast reloading of brads appears to be the primary benefit of the spring activation of this set tool.

Rayburn's set tool is not useful for finish hammering partially driven hardwood staples primarily because its round bore is not the right shape. Instead of a circular bore, a precision rectangular shaped staple slot sized for slide fit insertion of the crown of a hardwood staple is necessary. Furthermore, considerably more force is needed to finish hammer a hardwood staple, preferably by impact by a hammer. If a hammer were to be used, it would be preferable that the entire driving apparatus be more solid, and that it be closely supported along its entire length within a tubular body. Rayburn's plunger would likely bend within the open barrel if the forces necessary to drive a modern hardwood staple were repeatedly applied.

Finally, the process of finish hammering itself would be better facilitated by a spring urging the driving end of the rod (Rayburn's plunger) against the exposed head of the hardwood staple, rather than separating the hammering head (Rayburn's head and plunger) from the work (staple crown). This is because the finish hammering process likely requires repeated blows. A spring urging the driving head of the rod against the exposed head of the hardwood staple as it progresses down the staple channel would ensure the driving head was always in an ideal location. This could improve the precision and efficiency of the finish hammering operation.

What is needed is a set tool for finish hammering modern hardwood staples with a staple slot that properly supports the legs of these staples throughout the process. The body and the driving rod must have relieved edges so they can enter the external angle formed by the outer edge of the plank, and the tongue of the plank. The driving head of the rod needs a staple receiving groove to help locate the set tool on top of the exposed staple head, and to support the staple head as it is being finish hammered. A spring is needed to urge the staple receiving groove against the top of the exposed staple head at all times it is within the staple slot.

SUMMARY

The device is a set tool including a tubular body, and a rod assembly including a spring and a flanged bushing to retain the rod assembly within in the tubular body. On its bottom outer surface, the tubular body has relieved edges forming an included angle of about 75°, enabling it to enter the external angle formed by the outer edge of the hardwood plank, and the tongue of the plank. A thin flat tip surface is formed at the end of said relieved edges, which will be referred to herein as a staple insertion edge. Within the tubular body, a precision staple slot is formed having an opening at this staple insertion edge. The staple slot is centered on the centerline of the tubular body and on the vertex of the included angle formed by the relieved edges. The staple slot has a length, width and thickness permitting a precision slide fit of at least one entire leg length of a typical hardwood staple. In an area above the staple slot in the tubular body, and centered on the same centerline, a wider second hole is formed for holding the rod assembly. The profile of the rod can be any shape that slides within the tubular body. The rod includes a hammering head and a staple driving head. The staple driving head includes guidance means such as nubs insertable within the staple slot. When an exposed staple head is inserted within the staple slot, the guidance means also running within the staple slot guide the staple driving head to the exposed staple head for hammering. The rod preferably has a thickness greater than that of the hardwood staple so it can be more easily hammered. In such case, the staple driving head of the rod may have relieved edges to enter the external angle formed by the outer edge of the plank, and the tongue of the plank. The staple driving head may have a precision staple receiving groove for insertion of the longitudinally rounded crown of a hardwood staple. To complete the rod assembly, a flanged bushing is slid on the rod, followed by a spring, and finally a washer forming a footing for the spring. The washer is affixed to the rod by means of a pin press fit in a pin hole and located underneath the washer. The rod assembly is inserted into the tubular body. The guidance means on the staple driving end of the rod assembly are inserted within the staple slot. The assembly is retained in the tube by the screwing the flanged bushing into the top of the tubular body. In use, the user inserts the exposed staple head into the staple slot, and the staple driving head of the rod is urged backward within the body against the spring. The user hammers the hammering head of the rod several times in order to perform the finish hammering operation. After each hammer blow, the staple driving head moves with the staple as the staple is driven into the plank. Pressure from the spring keeps the staple driving head on top of the exposed staple head at all times. Support from the precision staple slot ensures the staple will not bend over during the process of finish hammering. The travel of the staple driving end of the rod is limited by a bottom surface of the hammering head contacting the top of the flanged bushing. This prevents damage to the vertex area of the external angle formed by the outside edge of the plank, and the tongue of the plank.

DETAILED DESCRIPTION OF THE INVENTION

Figure 1:
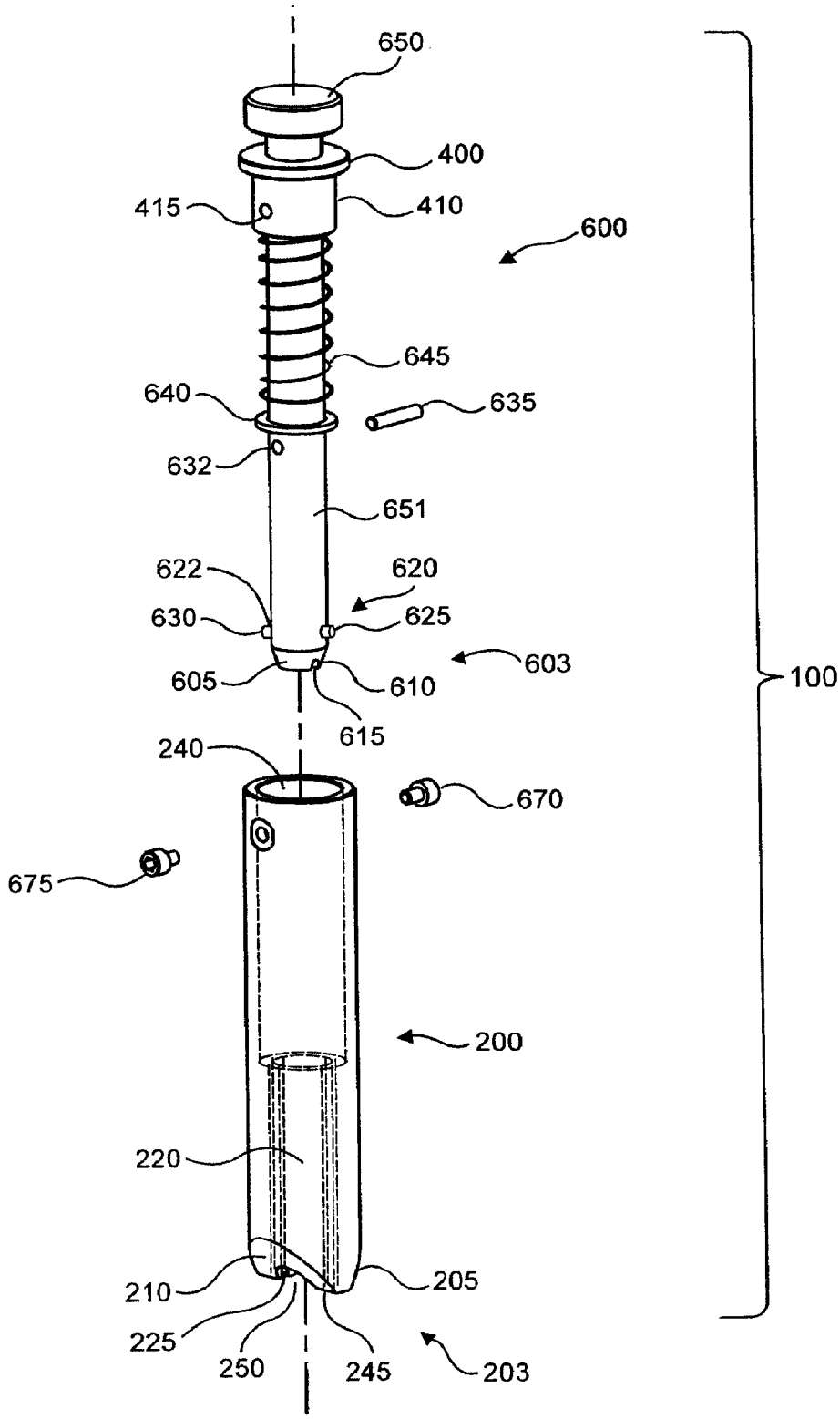
FIG. 1 is an exploded view of an embodiment of the set tool.
Figure 2:
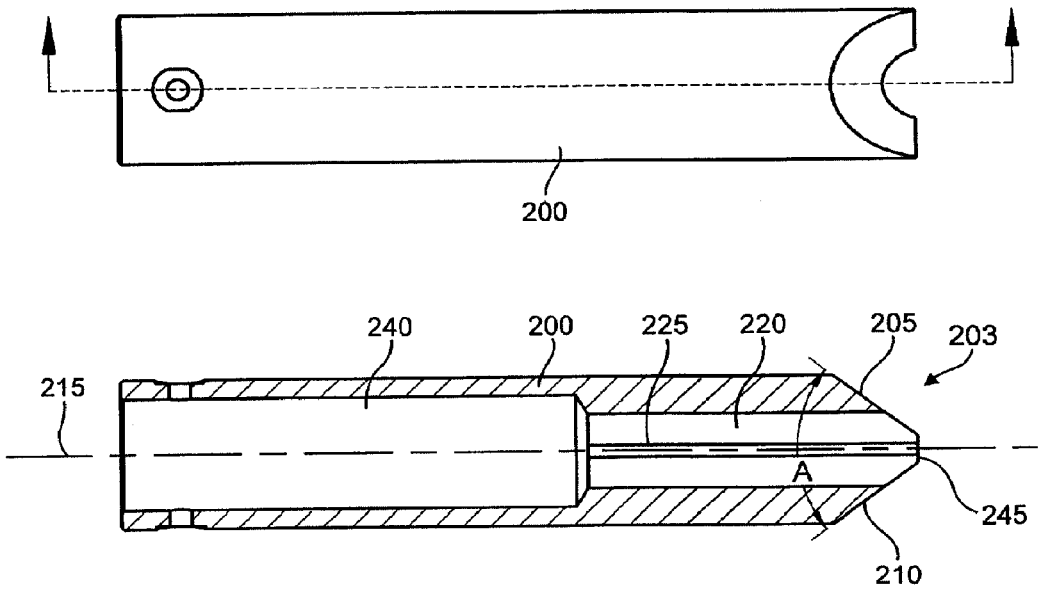
FIG. 2 is a side and cross section of the tubular body of the set tool of FIG. 1.

As shown in FIG. 1, the exploded view of set tool 100 includes a tubular body 200, and a rod assembly 600. Tubular body 200 has on its lower end 203 two relieved edges 205, 210 allowing tubular body 200 to enter the external angle formed by the outside edge of the hardwood plank, and the tongue of the plank. FIG. 2 shows a cross section of tubular body 200 showing that relieved edges 205, 210 form an included angle A of about 75°. The apex of angle A is centered on (and therefore also bisected by) centerline 215 of tubular body 200. A staple insertion edge 245 is formed at the most distal tip of tubular body 200.

A first circular bore 220 is formed through tubular body 200 centered on centerline 215. The diameter of first bore 220 is slightly smaller than the width of a typical hardwood staple. This is so that a staple slot 225 can be formed by the addition of two parallel rectangular channels within first bore 220. Above first circular bore 220 is a wider second bore 240 centered on this same centerline.

Figure 3:
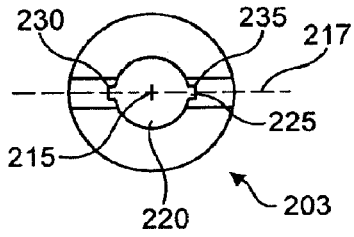
FIG. 3 is an end view of the tubular body of the set tool of FIG. 1.
Figure 4:
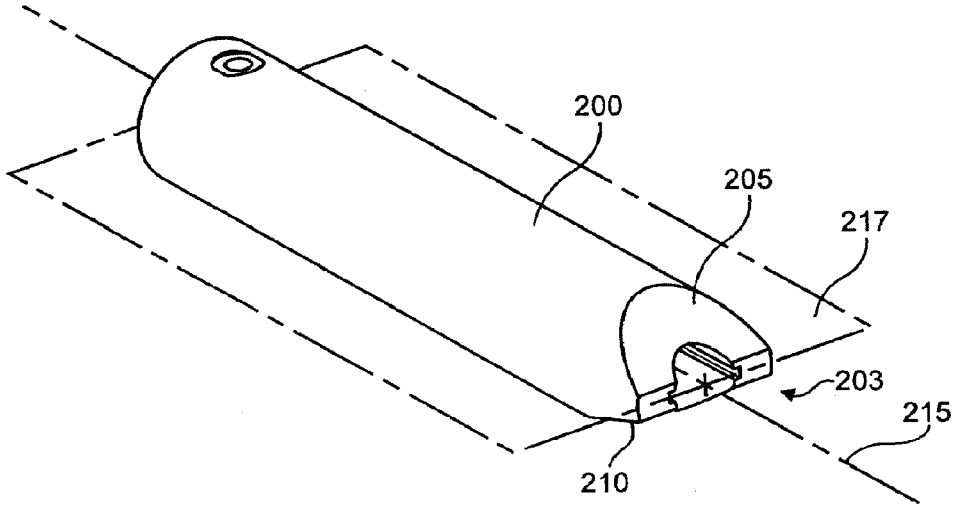
FIG. 4 is a perspective view of the tubular body of the set tool of FIG. 1 describing its geometry.

As shown in FIG. 4, which shows tubular body 200 laid over on another side, centerline 215 may be extended horizontally forming a plane 217 that bisects relieved edges 205, 210. As shown in FIG. 3, an end view of the bottom end 203 of tubular body 200 in the same orientation as FIG. 4, staple slot 225 is formed by the addition of two parallel rectangular channels 230, 235 within circular bore 220. Channels 230, 235 are centered on centerline 215 and bisected by plane 217. As used herein, channels 230, 235 "enlarge the perimeter" of first bore 220. The dimensions of staple slot 225 allow a precise slide fit to accept and support an exposed staple head during the process of finish hammering.

Figure 5:
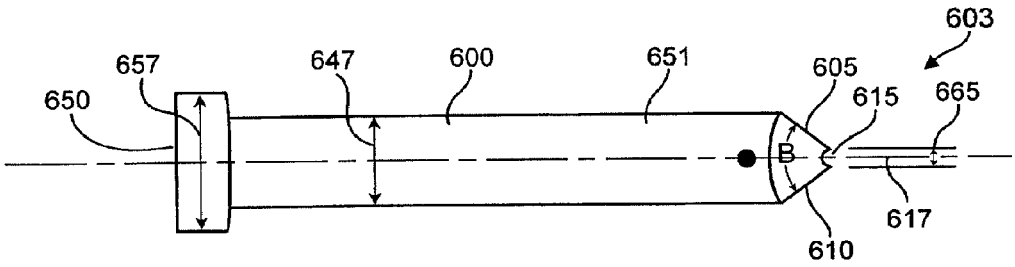
FIG. 5 is a side view of the rod of the set tool of FIG. 1.
Figure 6:
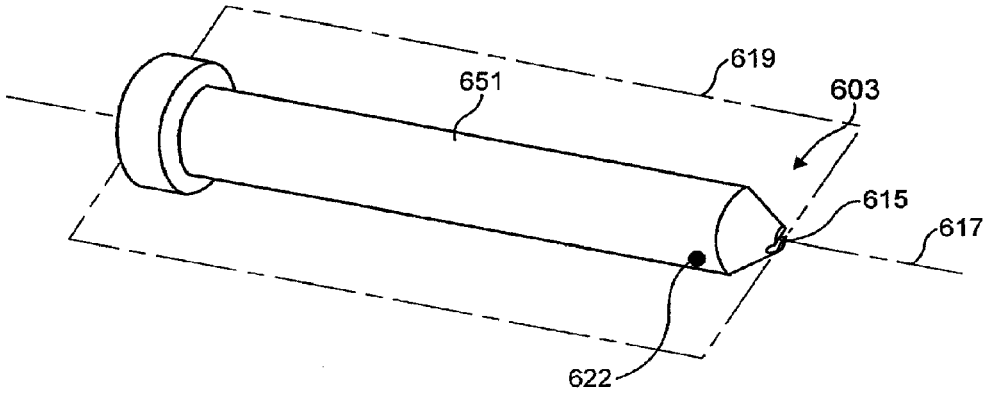
FIG. 6 is a perspective view of the rod of the set tool of FIG. 1 describing its geometry.

Returning to FIG. 1, set tool 100 includes a rod assembly 600. Rod assembly 600 includes a rod 615, a first pin 620 forming guide nubs 625, 630, a second retaining pin 635, a retaining washer 640, a coil spring 645, and a flanged washer 400. Rod 615 has a hammering head 650 on its upper end and a staple driving head 603 on its lower end. Staple driving head 603 has relieved edges 605, 610 allowing staple driving head 603 to enter the external angle formed by the outside edge of the hardwood plank, and the tongue of the plank. As shown in FIG. 5, rod 615 has a centerline 617. Relieved edges 605, 610 of staple driving head 603 form an included angle B of about 75° with an apex that is centered on (and bisected by) centerline 617. As shown in FIG. 6, centerline 617 may be extended horizontally to form a plane 619. On the distal tip of staple driving head 603, a horizontal, rounded staple receiving groove 615 is formed. Staple receiving groove 615 is bisected by plane 619. Behind staple receiving groove 615 and also bisected by plane 619 is hole 622.

The thickness of the rod could 615 could be any thickness, including, at a minimum, the thickness of a typical hardwood staple. However, for ease of hammering, and to prevent bending, it is preferred that rod 615 have a thickness greater than that of a typical hardwood staple. As shown in FIG. 5, rod 615 has a hammering head 650 with a thickness 657, and a body thickness 647 that is thicker than a typical hardwood staple (represented approximately by the width of staple receiving groove 615-dimension 665).

As shown in FIG. 1, for the subassembly of rod assembly 600, flanged bushing 400 is first slid onto rod 615. Next, coil spring 645 is slid onto rod 615, followed by retaining washer 640. Coil spring 645 and retaining washer 640 are held on rod 615 by inserting second pin 635 in a hole 632 below retaining washer 640. Finally, first pin 620 is inserted into hole 622 to form guide nubs 625, 630 for driving end 603.

To complete the assembly, rod assembly 600 is inserted into second bore 240 in tubular body 200. When driving end 603 reaches first bore 220, the guide nubs formed by pin 620 are inserted and run within staple slot 225 to staple insertion edge 245. Flanged bushing 400 is inserted into the top of second bore 240 and fastened to tubular body 200 with two screws 670, 675 screwing into two tapped holes 410, 415.

Figure 7:
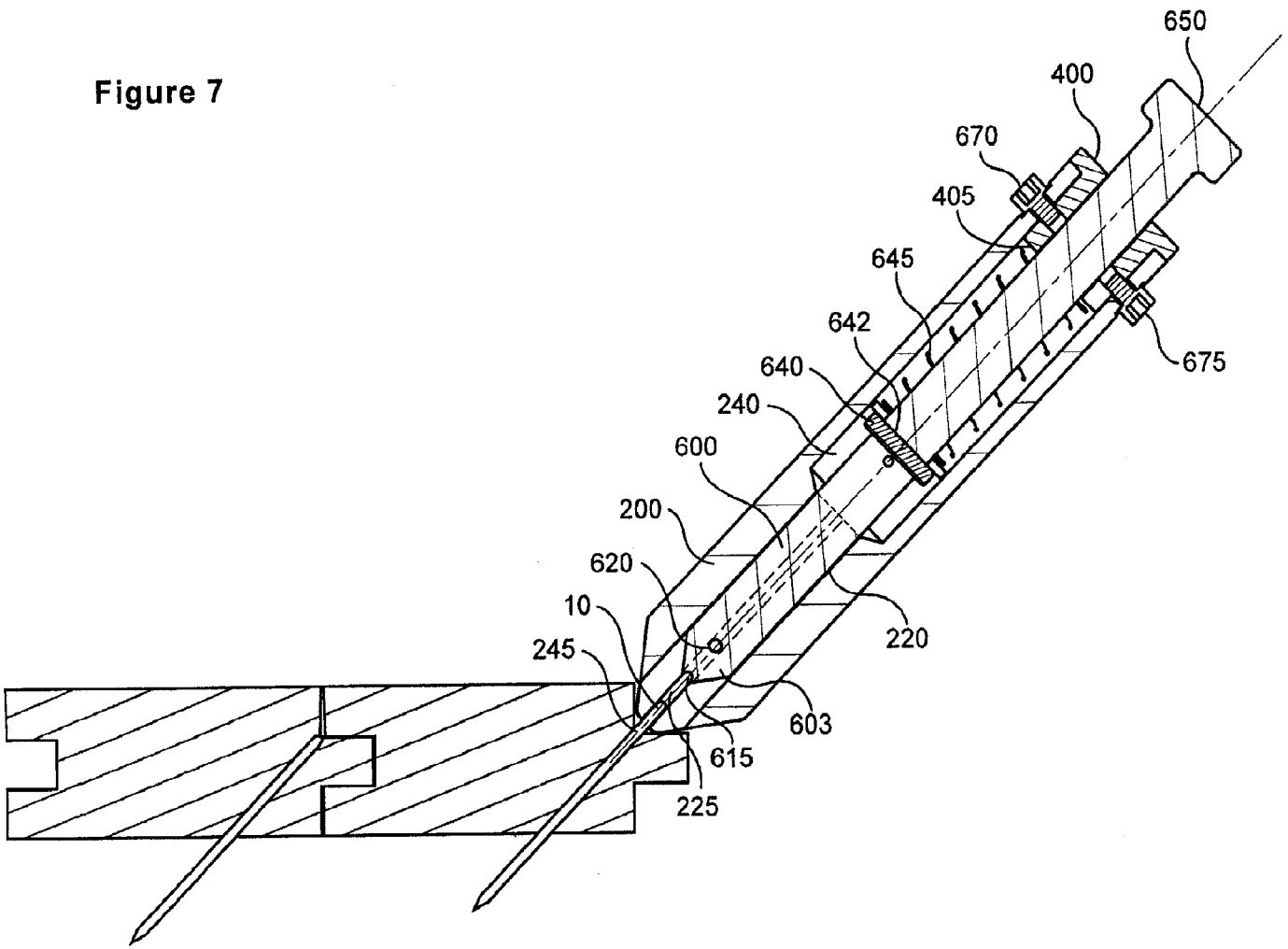
FIG. 7 is a vertical cross section of the assembled set tool in FIG. 1 in use against a hardwood flooring plank.

FIG. 7 is a vertical cross section of the assembled set tool in use against the side of a hardwood plank. An exposed staple head 10 enters tubular body 200 at a staple insertion edge 245. The exposed staple head is guided to staple receiving groove 615 in driving end 603 of rod 600 by staple slot 225. As the exposed staple head 10 is inserted deeper into staple slot 225, it pushes rod 600 and retaining washer 640 inward against coil spring 645. Coil spring 645 applies reverse pressure forcing staple receiving groove 615 of rod 600 against the top of exposed staple head 10. Staple slot 225 is formed all the way to the end of first bore 220. Staple slot 225 is long enough to accept the full leg length of one entire hardwood staple.

Once the exposed staple head is fully inserted into staple slot 225, hammering head 650 of rod 600 is extended from tubular body 200. The user hammers hammering head 650 with a hammer. Staple driving end 603 of rod 600 is kept in proper position over the exposed staple head by the nubs formed by pin 620 being retained within staple slot 225. Staple receiving groove 615 is kept constantly on top of the longitudinally rounded crown of the exposed staple head due to constant downward spring pressure from spring 645.

Staple slot 225 serves to support the legs of the hardwood staple throughout the process of finish hammering. Because staple slot 225 is at least as long as the length of a typical hardwood staple, it supports the legs of the staple no matter how far the exposed staple head protrudes from the side of the hardwood plank. With this design, the finish hammering procedure can be always be performed successfully.

Figure 15:
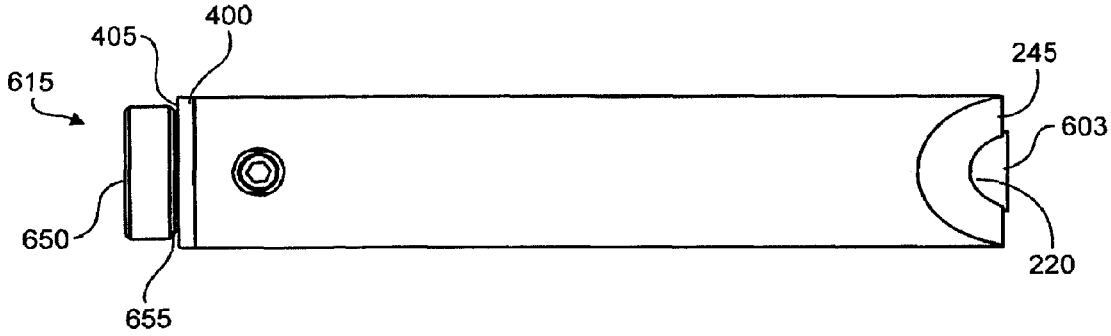
FIG. 15 is a side view of the assembled set tool showing how the extension of the staple driving head is limited.

As shown in FIG. 15, a side view of the assembled set tool, the travel of staple driving head 603 beyond staple insertion edge 245 is limited. A bottom surface 655 of hammering head 650 contacts a top surface 405 of flanged bushing 400, preventing further extension of staple driving head 603. This prevents damage to the plank at the vertex area of the external angle formed by the outside edge of the plank, and the tongue of the plank, which may be caused by excessive impact or over penetration of staple driving head 603. In order to drive the hardwood staple below flush into this vertex area, it is preferred that staple driving end 603 extend a slight distance from staple insertion edge 245. This distance can be controlled by the thickness of top surface 405 of flanged bushing 400.

A number of alternatives may be adopted to create a spring loaded set tool for hardwood staples. As shown in FIG. 1, first bore 220 and second bore 240 in tubular body 200 are round holes. The round shape of first bore 220 accommodates the round shape of rod 615. Round holes and rods are preferred due to the availability of low cost standard round drills and bar stock. However, in one alternative, this hole could be formed as any shape, such as an oval, triangle, or square, and have a rod of corresponding shape. Such a shape for the hole and rod would prevent the rod from rotating within the hole, which could eliminate the need for guide nubs on the staple driving head of the rod.

Figure 9:
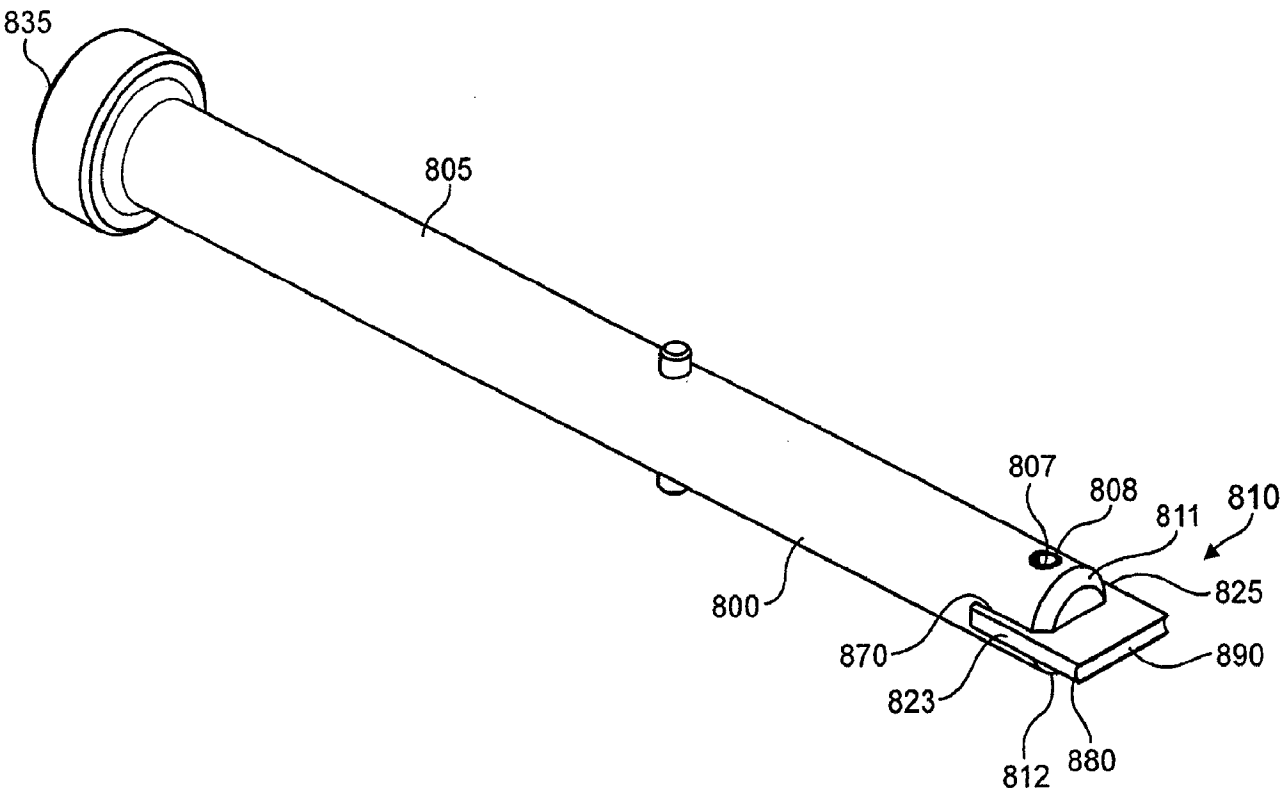
FIG. 9 is a perspective view of an alternative embodiment of the rod with a thin metal tip extension.
Figure 10:
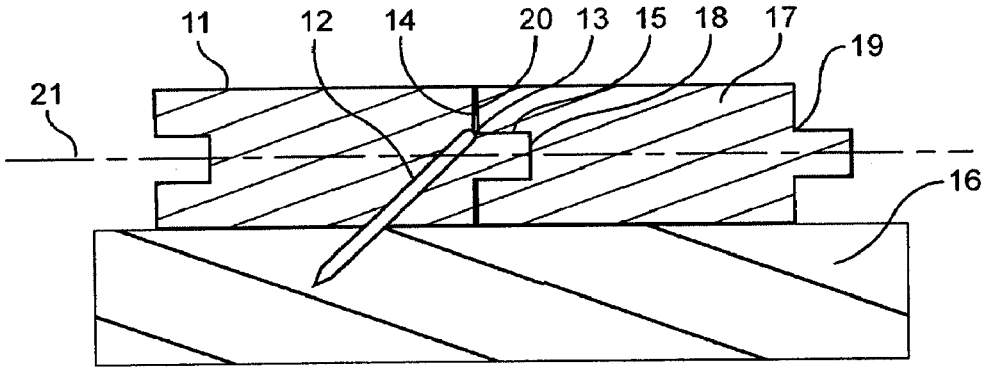
FIG. 10 is a cross-sectional view of a hardwood plank showing a properly driven hardwood staple.
Figure 11:
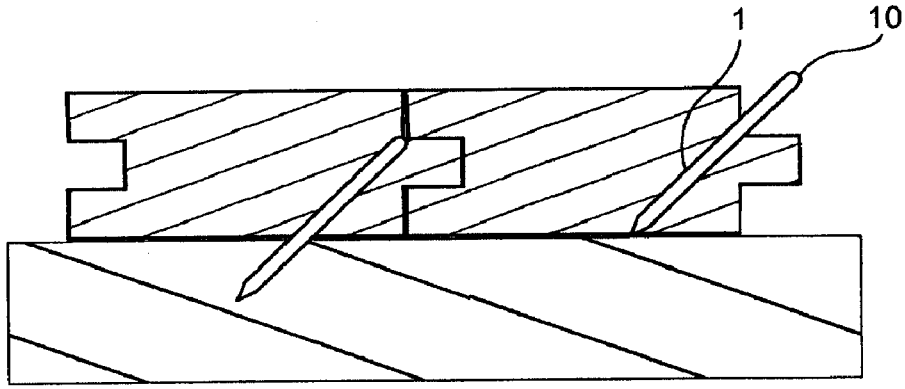
FIG. 11 is a cross-sectional view of an exposed staple head in a hardwood plank.
Figure 12:
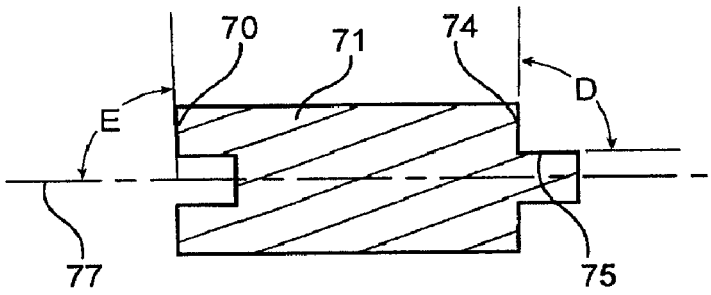
FIG. 12 is a cross section of a hardwood plank showing the angles formed by the outer edge of the plank on both the tongued side and the grooved side of the plank.
Figure 13:
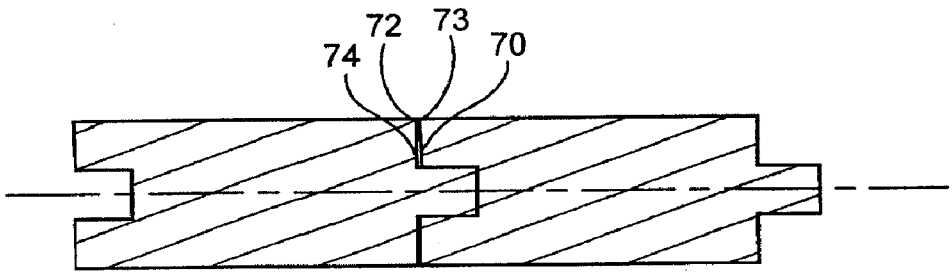
FIG. 13 is a cross section of two hardwood planks showing how the angles formed by the relieved outer edges on both the tongue and grooved sides the plank interact to prevent a gap from forming between the planks.

In one preferred embodiment, the rod includes a staple driving head having a relieved end forming an included angle shape, and an integral staple receiving groove formed into the relieved end. This configuration is preferred due to low manufacturing cost due to minimal parts. In another alternative, the set tool could include a driving head with a separate thin tip extension inserted within a slot formed in the driving head. As shown in FIG. 9, rod 800 has a staple driving end 810 that includes a slot 870. Inserted into slot 870 is a tip 880 that could be formed as a metal stamping from a thin piece of metal. Tip 880 has a staple receiving groove 890 formed in its end. Tip 880 is fastened to rod 800 by press fitting a pin 807 into a hole 808. Tip 880 is slightly wider than body 805 of rod 800. This is so that two protruding edges 823, 825 form guide nubs that may guide staple driving end 810 when inserted into a staple slot.

Tip 880 is thin and easily enters the external angle formed by the outside edge of the hardwood plank, and the tongue of the plank. However, relieved edges 811, 812 in staple driving end 810 are still needed to allow staple driving end 810 to easily enter the external angle formed by the outer edge of the hardwood plank, and the tongue of the plank.

A thin tip such as tip 880 can have several advantages in the event that a higher priced, more durable, and more functional set tool is desired. Rod 800 can be formed as a body 805 from a first material having sufficient impact resistance for safe hammering at hammering end 835. Tip 880 may be made from a harder material which can be precision ground on the end to form a staple receiving groove 890 that conforms with the longitudinally rounded shape of the crown of the hardwood staple. Tip 880 can better drive the exposed hardwood staple head below flush into the side of hardwood plank. The lack of any exposed hardwood staple head whatsoever at the tongue and groove joint can make it easier to get the joint between planks together.

Figure 8:
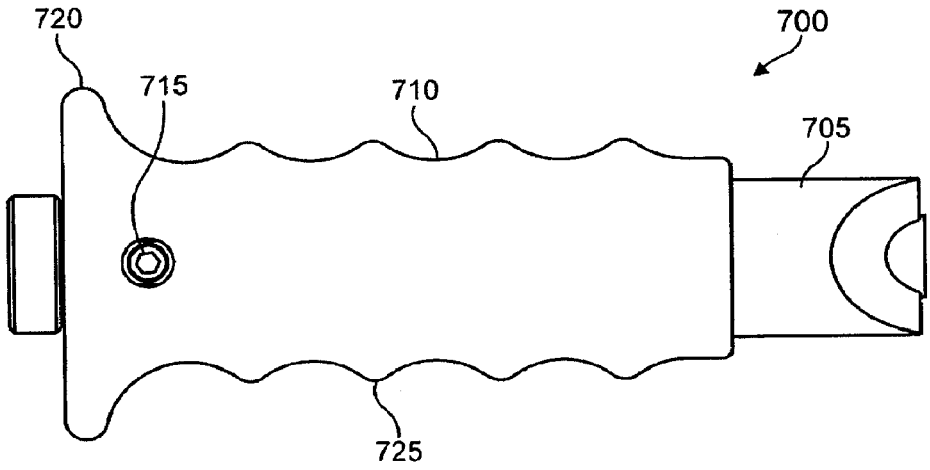
FIG. 8 is a side view showing an alternative embodiment including a feature to protect the hand incorporated with the set tool to protect the hand from off center blows from a hammer.

In another alternative, the tubular body of the set tool could incorporate a means to protect the hand from off center blows from a hammer. As shown in FIG. 8, set tool 700 has a rubber jacket 710 over body 705 held in place by a screw 715. Rubber jacket 710 has an upper rib 720 above the handle grip body area 725 to protect the hand from off center blows from a hammer.

Figure 16:
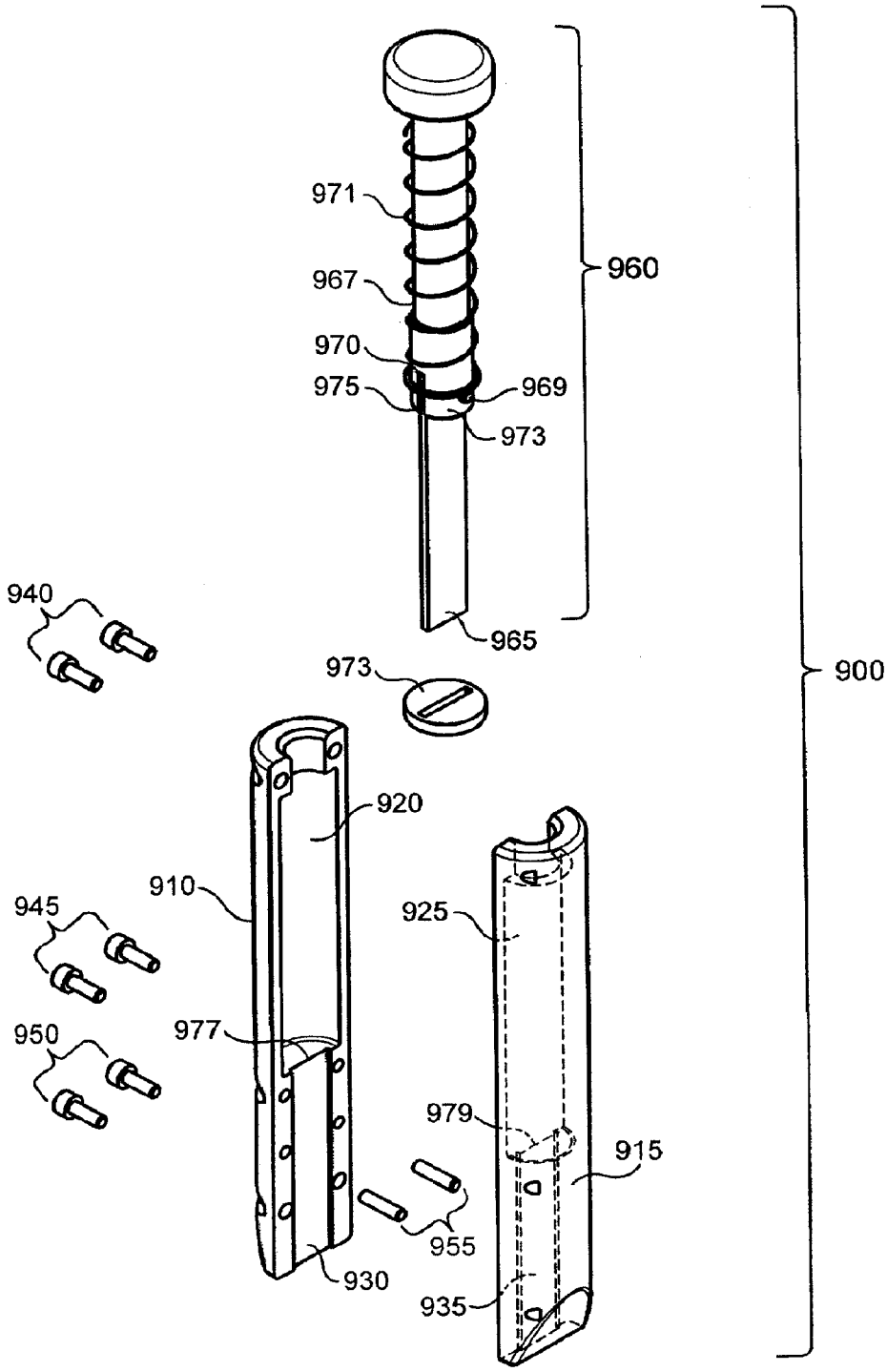
FIG. 16 is an exploded view of an alternative embodiment with a tubular body formed in two sections, and includes a minimum clearance slot.

In another alternative, the tubular body of the set tool could be formed in two halves, which when fastened together internally form a staple slot and an upper pocket for housing a rod and spring. As shown in FIG. 16, set tool 900 includes a first half 910 and a second half 915. First half 910 has an upper recess 920, and a lower recess 930, and second half 915 has an upper recess 925, and a lower recess 935 of corresponding shape and location. First half 910 and second half 915 are fastened together with pairs of threaded fasteners 940, 945, 950, and pins 955. When halves 910, 915 are fastened together, upper recesses 920, 925 form an upper pocket (also referred to herein as an "upper hollow") for housing a rod and a spring, and lower recesses 930, 935 form a staple slot. In this alternative, the recesses may be formed by conventional end mills on a milling machine or investment casting methods, rather than drills and/or broaching tools. As a result, the staple slot formed by lower recesses 930, 935 can be much thinner and narrower. In one embodiment, the staple slot has only the width and thickness necessary for slide fit insertion of an exposed staple head.

When the staple slot has only the width and thickness necessary for slide fit insertion of an exposed staple head, an alternative rod assembly such as rod assembly 960 must be employed. Rod assembly 960 has a staple driving end including an elongate driving tip that is thin and narrow enough to slide within a staple slot of this shape. Such an elongate driving tip must also be long enough to contact the staple head at whatever distance it may slide up to within the staple slot. Rod assembly 960 includes a rod 967 having a driving head 973. Driving head 973 includes a slot 970 for insertion of an elongate driving tip 965. Elongate driving tip 965 is fastened to rod 967 by a pin 969. A spring 971 presses against pin 969 when spring 971 is within the upper hollow. Spring 971 urges the distal end of elongate driving tip 965 against an exposed staple head when it is inserted within the staple slot. A stopper 973 may be slid onto tip 965 to prevent upper edges 977, 979 (of lower recess 930, 935 respectively) from being deformed by impact from a lower end 975 of rod 967. As with the alternative rod shown in FIG. 9, rod assembly 960 can be manufactured with a metal tip 965 made from a first hardened material, and a separate rod 967 made from a tough tool steel material suitable for hammering.

The thinner and narrower staple slot of this alternative has several advantages. First, it provides better support for the staple. Secondly, a set tool with a thin and narrow staple slot can be used to finish hammer other less common hardwood flooring fasteners such as the "cleat" 1000 of FIG. 17. Cleat 1000 has a length 1001 about the same length 51 (FIG. 14) or slightly shorter than hardwood staple 50. Cleat 1000 has a width 1002 significantly narrower than width 52 (FIG. 14) of hardwood staple 50, and a thickness 1003 thinner than thickness 53 (FIG. 14) of hardwood staple 50. The thinner and narrower staple slot of this alternative can successfully finish hammer such cleats, as it provides sufficient support for the cleat on at least three sides. This alternative set tool is preferred for greater versatility. Making the tubular body in two halves and forming the internal features as recesses as in this embodiment permits also permits more economical machining, and lower manufacturing cost.

Figure 14:
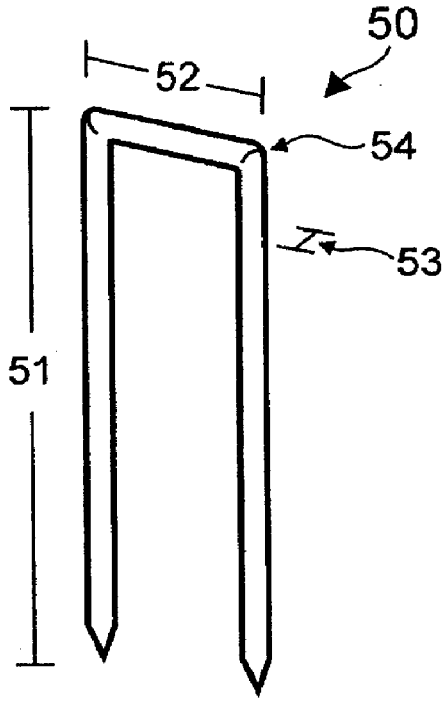
FIG. 14 is a perspective view of a typical hardwood staple.
Figure 17:
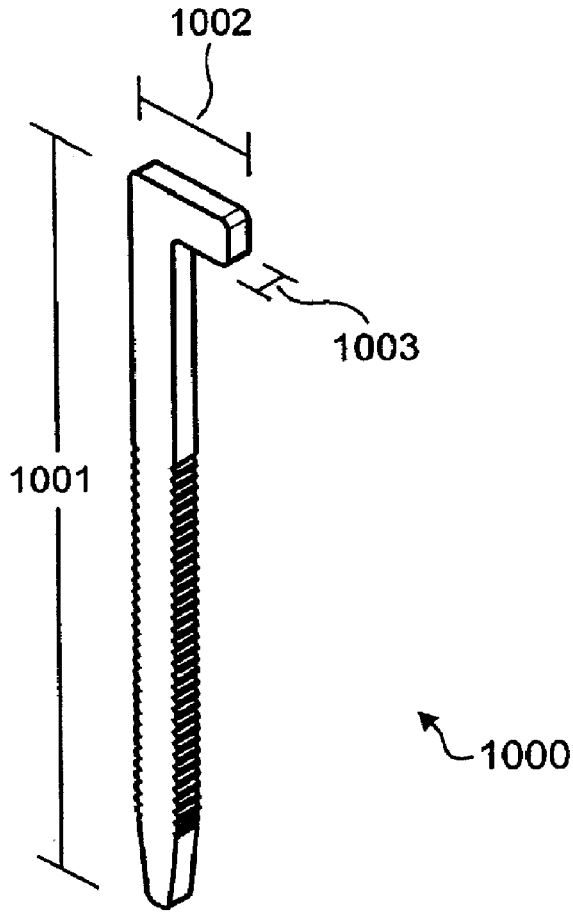
FIG. 17 is a perspective view of a hardwood flooring cleat.

As used herein, the term "hardwood flooring staple" includes both hardwood staples of the kind shown in FIG. 14, and hardwood cleats such as that which is shown in FIG. 17. Whether the set tool is used for finish hammering the exposed head of a hardwood flooring staple, or the exposed head of a hardwood flooring cleat, the functions of the elements are similar.

As used herein, a set tool for hardwood flooring staples with an opening for insertion of an exposed hardwood staple head, where said opening has only the width and thickness necessary for slide fit insertion of an exposed head of a hardwood flooring staple will be referred to as a "minimum clearance slot".

Figure 18:
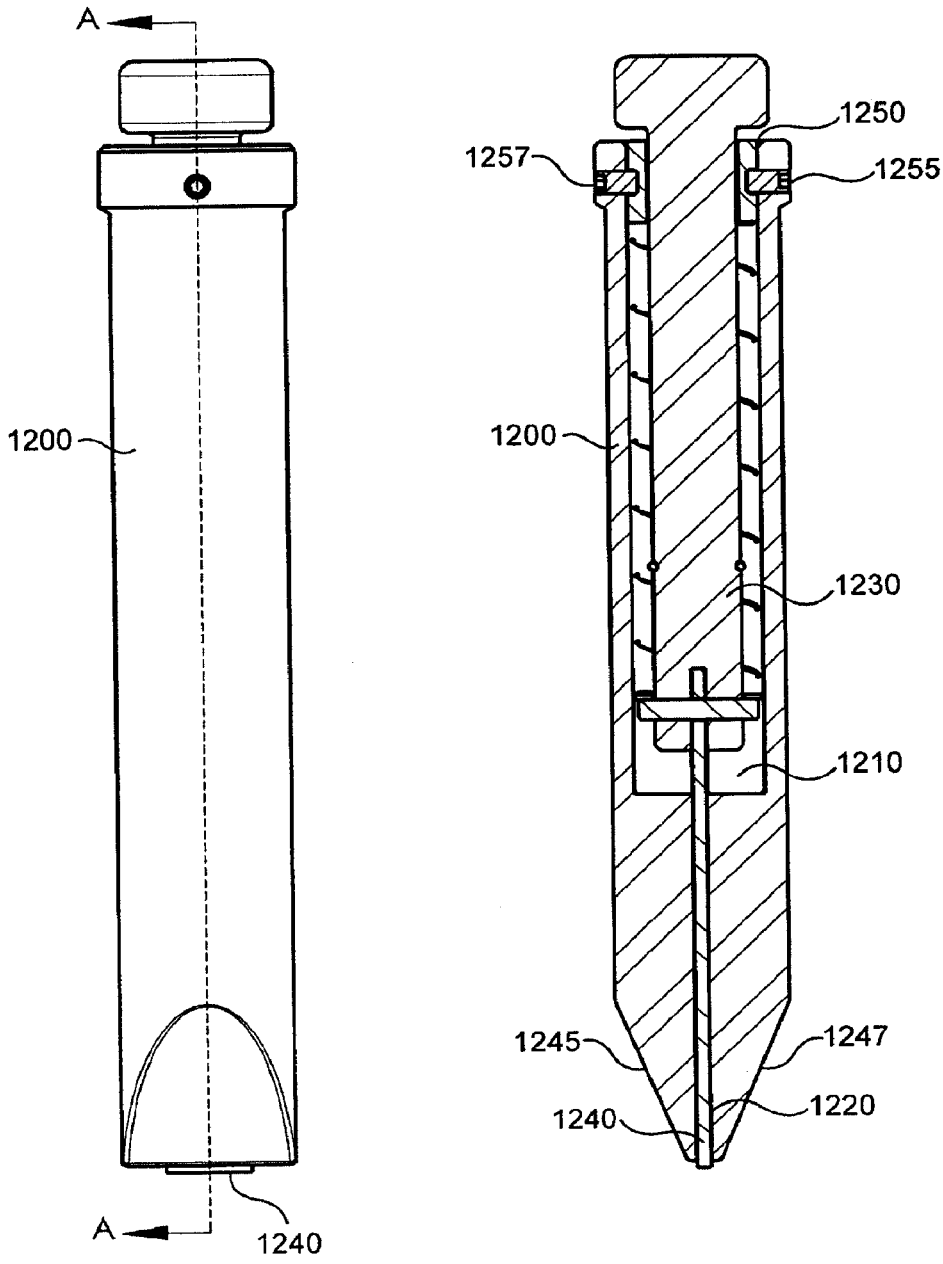
FIG. 18 is a section view of an alternative embodiment having a tubular body formed as a single piece of material, but also including a minimum clearance slot.

In another alternative, the tubular body of set tool 900 of FIG. 16 could be made as a single part by means of investment casting methods. FIG. 18 shows a section view of a tubular body 1200 having an upper hollow 1210 and a minimum clearance staple slot 1220. The rod assembly 1230 is constructed similarly to rod assembly 960 of FIG. 16. Rod assembly 1230 has a similar thin, narrow elongate tip 1240 which may be inserted within minimum clearance slot 1220. The external shape of a one piece tubular body could be any shape, so long as it includes relieved edges such as 1245, 1247. A round exterior is preferred, because it is more easily accommodates hand protection means such as that shown in FIG. 8. However, the internal shapes of a one piece tubular body such as tubular body 1200 are most easily formed when the slots or hollows have uniform section widths. Especially for investment casting processes, such hollows or slots are most easily formed by removal of slides. Hence in addition to upper hollow 1210, set tool 900 includes second bushing 1250 to form a ceiling for upper hollow 1210. Bushing 1250 is fastened to tubular body 1200 by screws 1255, 1257.

The embodiments may be characterized in a number of different ways. For example, the device may be sold as a complete set tool, including both a tubular body and a rod. Alternatively, the tubular body and rod may be sold separately, with other components such as the spring as optional features, requiring final assembly by a user.

In the above section, it is noted that the tool may be used to drive in staples that were not fully driven into a hardwood flooring plank. The set tool may also be used to drive staples if required.

What is claimed is:

1. A set tool for finish hammering an exposed head of a hardwood flooring staple having a thickness, a width and a length into a tongue and groove hardwood flooring plank, comprising:

a tubular body, including:

a tip end having relieved edges insertable into an external angle formed by an outer edge of a hardwood flooring plank and the tongue of said hardwood flooring plank, said relieved edges converging at a staple insertion edge;

a staple slot for insertion of said exposed staple head, said staple slot having an opening at said staple insertion edge, said staple slot having a width and thickness for slide fit insertion of said exposed head, said staple slot having opposed first and second surfaces spaced apart by the staple slot width and slidably fitting the width of the hardwood flooring staple, said staple slot further having opposed third and fourth surfaces spaced apart by the staple slot thickness and slidably fitting the hardwood flooring staple thickness; and a rod insertable into said tubular body, said rod including:

a hammering head at a first end of the rod configured to receive impact force from a head of a hammer;

a staple driving head at a second end of the rod configured to transfer said impact force to said exposed head of said hardwood flooring staple;

wherein when said rod is inserted into said tubular body, and said exposed head is inserted into said staple slot, said staple driving head of said rod is guided to said exposed head.

2. The set tool of claim 1, wherein said rod has a thickness greater than the thickness of said hardwood flooring staple, and said tubular body has a hole permitting slide fit insertion of said rod.

3. The set tool of claim 2, wherein said staple slot is formed by means of two channels enlarging the perimeter of said hole, said channels having an opening at said staple insertion edge, said rod including at least one guide nub insertable into at least one of said channels, said at least one of said channels guiding said at least one guide nub such that said staple driving head is guided to said exposed staple head.

4. The set tool of claim 1, wherein said staple driving head of said rod includes a staple receiving groove configured to accept the crown of said hardwood flooring staple.

5. The set tool of claim 1, further including a spring insertable into said tubular body, said spring configured to bias the rod such that said staple driving head is urged against said exposed staple head when said exposed staple head is in said staple slot.

6. The set tool of claim 1, further comprising a jacket on an upper exterior of said outer tubular body, said jacket configured to have an upper flared end of sufficient width to provide protection to a user's hand from errant hammer blows.

7. The set tool of claim 1, wherein said rod and said hammering head are made from a first material, and said staple driving head includes a separate tip made of a second material.

8. The set tool of claim 1, wherein said staple driving head includes a separate tip having a tip width configured to slidably fit into said staple slot.

9. A set tool for finishing hammering an exposed head of a hardwood flooring staple into a tongue and groove hardwood flooring plank, comprising:

an outer tubular body including:

a first end having relieved edges insertable into an external angle formed by an outer edge of said hardwood plank and the tongue of said hardwood flooring plank, said relieved edges converging at a staple insertion edge;

an internal staple slot for insertion of a staple head, said staple slot having an opening at said staple insertion edge, said staple slot having a width and thickness for slide fit insertion of an exposed staple head; and a rod insertable into said tubular body, said rod including:

a hammering head at a first end of the rod;

a staple driving head at a second end of the rod;

a biasing mechanism insertable within said outer tubular body;

wherein when said biasing mechanism is inserted within said outer tubular body, said biasing mechanism provides a biasing force to said rod such that when an exposed head of a hardwood staple is inserted into said staple slot, said rod is retracted and said staple driving head of said rod is biased towards said exposed head of said hardwood flooring staple.

10. The tool of claim 9, wherein said relieved edges form an angle of essentially 75 degrees.

11. The tool of claim 9, wherein said staple driving head has relieved edges insertable into an external angle formed by said outer edge of said hardwood flooring plank and said tongue of said hardwood flooring plank.

12. The tool of claim 9, wherein said outer tubular body has an upper internal bore of a greater diameter and a lower internal bore of a lesser diameter, the biasing mechanism contained in said upper bore and the internal staple slot in the lower bore.

13. The tool of claim 9, wherein said rod includes a means for maintaining rod orientation as the rod moves within the outer tubular body.

14. The tool of claim 9, further comprising a jacket on an upper exterior of said outer tubular body, said jacket configured to have an upper flared end of sufficient width to provide protection to a user's hand from errant hammer blows.

15. The tool of claim 9, wherein said staple driving head includes a tip having a tip width configured to slidably fit into said staple slot.

16. A set tool for finish hammering the exposed head of a hardwood flooring staple into a tongue and groove hardwood flooring plank, comprising:

an elongate body, including:

a tip end having relieved edges insertable into an external angle formed by an outer edge of said hardwood flooring plank and the tongue of said hardwood flooring plank, said relieved edges converging at a hardwood flooring staple insertion edge;

a slot for insertion of said hardwood flooring staple, said slot having an opening at said hardwood flooring staple insertion edge;

an upper hollow having a first opening at the top of said slot, and a second opening through to a top surface of said elongate body; and a rod insertable into said second opening of said tubular body, said rod including:

a driving head at a first end of the rod, said driving head including an elongate driving tip, said elongate driving tip insertable within said slot, said elongate driving tip having a length sufficient to impact said exposed head of said hardwood flooring staple when it is in within said slot; and a hammering head at a second end of the rod, said hammering head configured to receive impact force from a head of a hammer and transfer it to said elongate driving tip;

wherein with said rod inserted into said body, said hardwood flooring staple being inserted into said slot at said staple insertion edge retracts said elongate driving tip.

17. The set tool of claim 16, wherein said elongate body is formed by joining two or more sections, said sections having inner recesses forming said slot and said upper hollow when said sections are joined together.

18. The set tool of claim 16, further including a spring insertable into said upper hollow, said spring configured to bias the rod such that said elongate driving tip of said driving head is urged against said exposed head of said hardwood flooring staple when said exposed head of said hardwood flooring staple is in said slot.

19. The set tool of claim 16, wherein said elongate body is formed from a single piece of material.

20. The set tool of claim 19, wherein said tubular body includes a bushing inserted and fastened within said opening of said upper hollow, said bushing forming a ceiling surface within said upper hole that retains said rod within said upper hollow.

21. The set tool of claim 16, 17 or 19, wherein said slot is a minimum clearance slot.

22. The set tool of claim 16, wherein said hammering head has a thickness greater than said elongate driving tip on said staple driving head.

23. A stapling tool for stapling hardwood tongue and groove flooring planks into a subfloor surface, comprising:

a tubular body, including:

a tip end having relieved edges insertable into an external angle formed by an outer edge of a hardwood flooring plank and the tongue of said hardwood flooring plank, said relieved edges converging at a staple insertion edge; and a staple slot for insertion of a hardwood flooring staple and having an opening at said staple insertion edge; and a rod slidably inserted into said tubular body, said rod including:

a hammering head at a first end of the rod configured to receive impact force from the head of a hammer; and a staple driving head at a second end of the rod configured to transfer said impact force to said hardwood flooring staple;

wherein said hardwood flooring staple being inserted to said staple slot opening retracts said staple driving head.

24. The stapling tool of claim 23, further including a mechanism biasing said staple driving head towards said inserted staple.

25. The stapling tool of claim 23, wherein said staple driving head of said rod includes a separate tip insertable into said staple slot.

* * * * *